US006041576A

United States Patent [19]

Anchor et al.

[11] Patent Number: 6,041,576

[45] Date of Patent: Mar. 28, 2000

[54] FILL SYSTEM FOR PARTICULATES

[75] Inventors: David Anchor, Union; Paul Anderson, Addison, both of Ill.

[73] Assignee: Tetra Laval Holdings & Finance, SA, Pully, Switzerland

[21] Appl. No.: 09/070,342

[22] Filed: Apr. 30, 1998

[51] Int. Cl.[7] ..... B65B 3/06; B65B 29/00; B65B 39/00

[52] U.S. Cl. ..... 53/473; 53/266.1; 53/437; 141/275; 141/311 A

[58] Field of Search ..... 53/474, 473, 525, 53/437, 267, 268, 274, 284.5, 266.1, 271; 141/67, 172, 105, 101, 275, 253, 374, 311 A, DIG. 2

[56] References Cited

U.S. PATENT DOCUMENTS

| | | | |
|---|---|---|---|
| 2,608,335 | 8/1952 | Rohdin | 141/356 X |
| 2,725,069 | 11/1955 | Shanhouse et al. . | |
| 2,763,416 | 9/1956 | Wormser | 141/374 X |
| 2,765,601 | 10/1956 | Anderson | 53/267 X |
| 2,885,845 | 5/1959 | Ryan, Jr. | 53/268 X |
| 3,106,231 | 10/1963 | Lehmann | 141/253 |
| 3,330,310 | 7/1967 | Heffelfinger et al. | 141/140 |
| 3,402,857 | 9/1968 | Ecklund et al. | 222/189 |
| 3,924,666 | 12/1975 | Raison | 141/231 |
| 4,235,265 | 11/1980 | Feliks | 141/85 |
| 4,815,666 | 3/1989 | Gacka et al. | 239/697 |
| 4,817,688 | 4/1989 | Corniea | 141/140 |
| 4,999,971 | 3/1991 | Ueda et al. | 53/266.1 |
| 5,090,299 | 2/1992 | Santi et al. . | |
| 5,287,997 | 2/1994 | Rodrigue et al. | 222/380 |
| 5,488,812 | 2/1996 | Stark et al. | 53/266.1 |
| 5,758,698 | 6/1998 | Kaneko | 141/263 |

*Primary Examiner*—James F. Coan
*Attorney, Agent, or Firm*—Welsh & Katz, Ltd.

[57] ABSTRACT

A filling system for filling soup into gable top cartons is disclosed wherein the dripping of soup from the fill tube is substantially diminished by the present invention. The filling system includes a product tank, a knife-gate valve, a pump mechanism, a fill tube with a circumferential recessed area, and a sealing cone with a cutting edge. The cutting edge of the sealing cone prevents particulates from interfering with the sealing of the fill tube by the sealing cone. The knife-gate valve prevents the flow of product from the product tank during filling of a carton. The product tank may have an agitating means for evenly distributing the particulates throughout the soup.

16 Claims, 13 Drawing Sheets

FILL SYSTEM FOR PARTICULATES

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to filling systems for packaging machines. Specifically, the present invention relates to a filling system for filling particulates into a carton being conveyed on a form, fill and seal packaging machine.

2. Description of the Related Art

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank, seal the tops of the cartons, and off-load the filled cartons for shipping.

A popular type of carton is an Extended Shelf Life ("ESL") carton due to the added value such a carton presents to a retailer. For example, pasteurized milk processed and packaged under typical conditions has a shelf life at four degrees Celsius of seven to fourteen days while the same milk processed and packaged under ESL conditions has a shelf life of fourteen to thirty days. Under ESL conditions, juice may have a shelf life of forty to one hundred twenty days, liquid eggs sixty to ninety days, and egg nog forty-five to sixty days. Thus, ESL packaging greatly enhances a product since it extends the time period that the particular product may be offered for sale to the consuming public. An ESL carton is the final component of an ESL system that entails ESL processing and ESL filling. In order to have ESL filling, the filling system should be kept sterile in order to prevent contamination of the product or carton during filling on a form, fill and seal package machine.

Recently, the packaging of soups in cartons has become popular in the food industry. In order to have soup cartons with an extended shelf life, the sealing of the carton must be tight. The dripping of soup onto the seal area of a carton will have an adverse effect on the seal, thereby rendering the product defective. One major cause of dripping is the lack of proper closure between a nozzle and a fill pipe. The improper closure arises from particulates in the soup preventing full closure.

Another problem with filling liquid products having particulates, such as soup, is providing an even distribution of particulates throughout the liquid portion. Without overcoming this problem, each carton would have a different quantity of particulates to liquid.

BRIEF SUMMARY OF THE INVENTION

The present invention is able to overcome the problem with filling particulates in a carton by providing a novel filling system. The present invention also provides for an even distribution of particulates throughout the liquid portion.

One aspect of the present invention is a filling system for filling cartons with a liquid product with particulates therein such as soup. The cartons are conveyed along a predetermined path by means of conveyor belt or the like. The filling system includes a fill pipe, a sealing cone, a pump, a knife gate valve and a product tank. The fill pipe is disposed above the predetermined path and has a dispensing end and an inlet end. The dispensing end has a circumferential recessed portion. The sealing cone has a linkage through the fill pipe to a control mechanism. The sealing cone has a cutting edge that mates with the circumferential recessed portion of the fill pipe to prevent dripping and to cut-off any lingering particulates. The pump mechanism has a pump chamber in flow communication with the fill pipe and a piston. The product tank holds the liquid product with particulates and is in flow communication with the pump chamber. The knife-gate valve is juxtaposed between the product tank and the pump chamber. The knife-gate valve controls the flow of liquid product with particulates from the product tank to the pump chamber. The product tank may have a means for agitating the liquid product with particulates.

Another aspect of the present invention is a packaging machine having the filling system as described above thereon. Yet another aspect of the present invention is a method for filling a container with a liquid product having particulates.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a schematic view of the filling system of the present invention;

Figure 2:
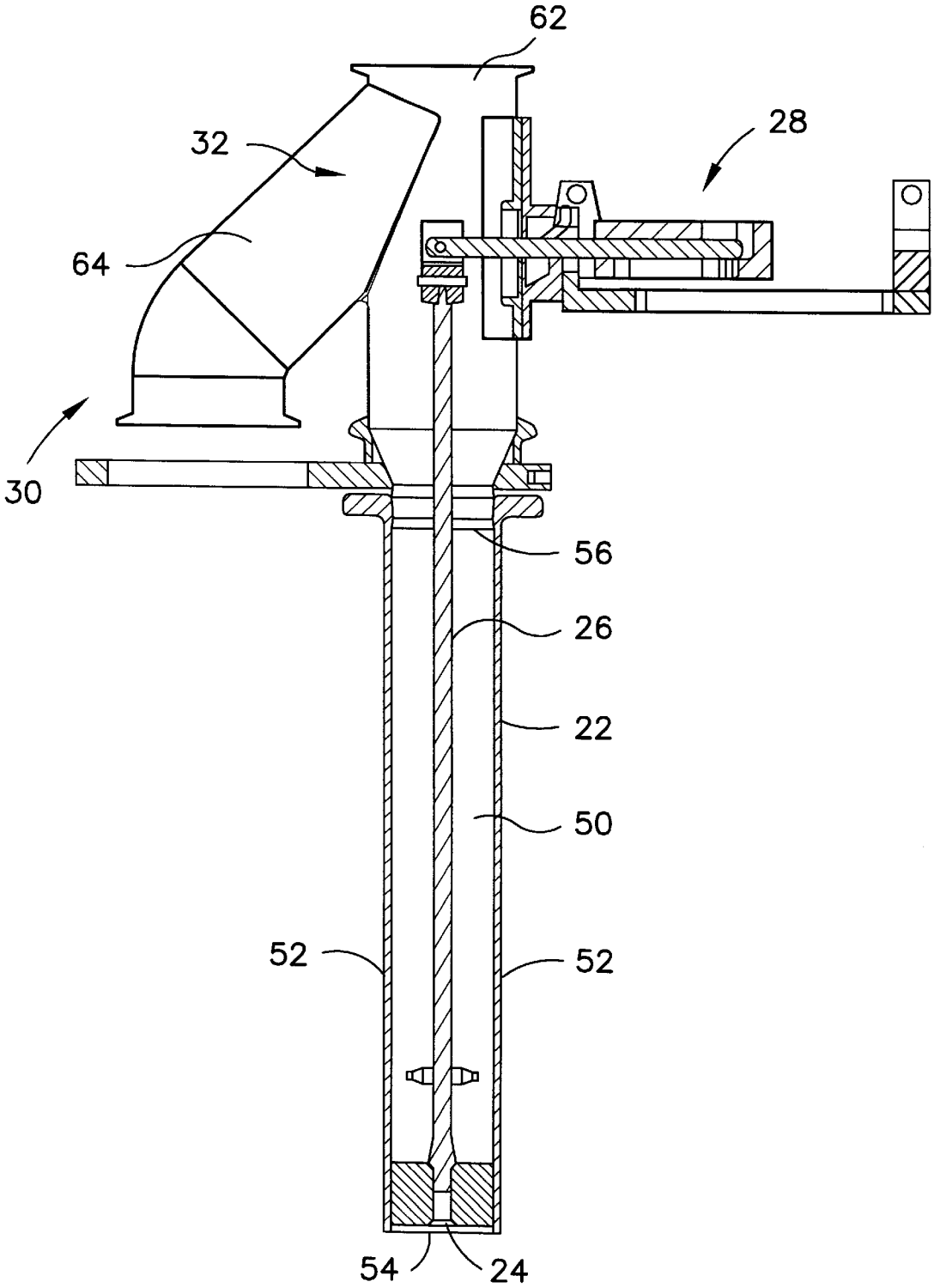
Figure 3:
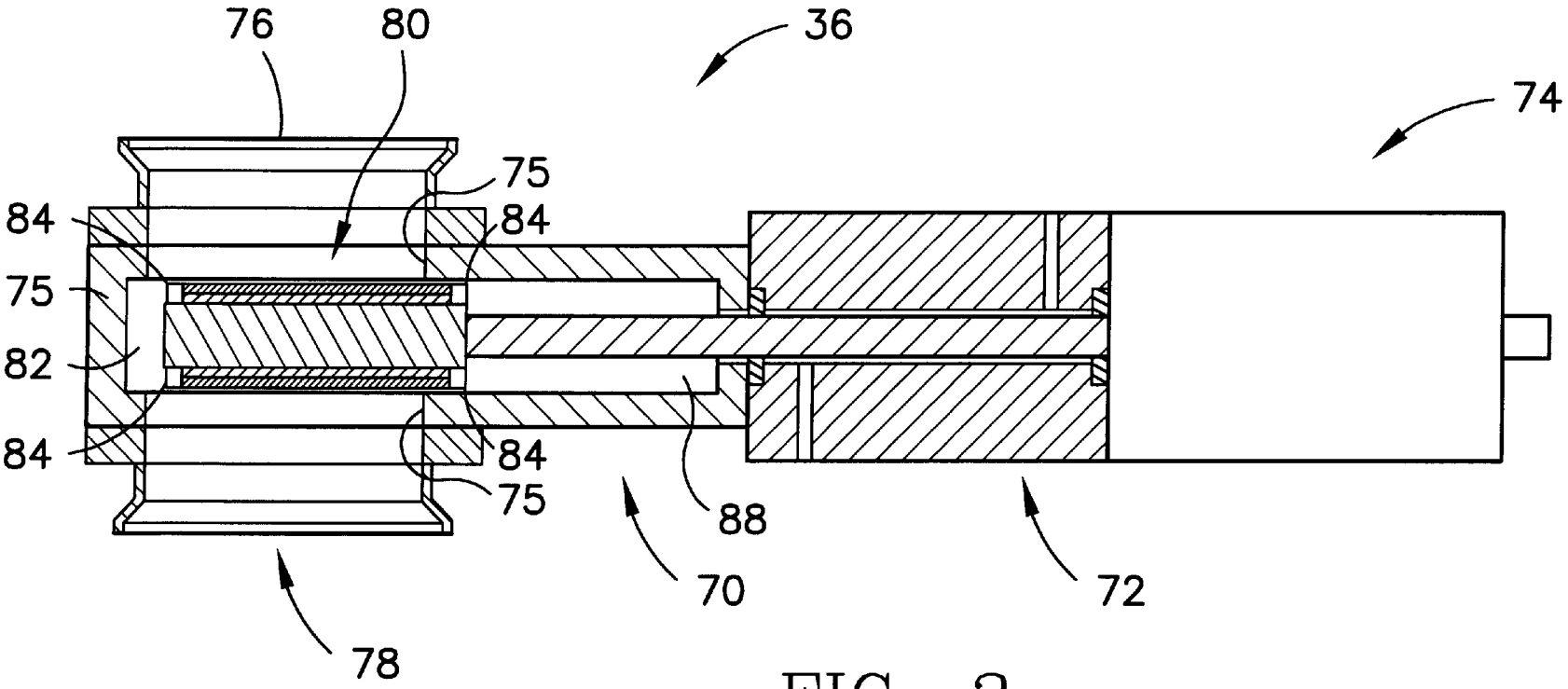
Figure 5:
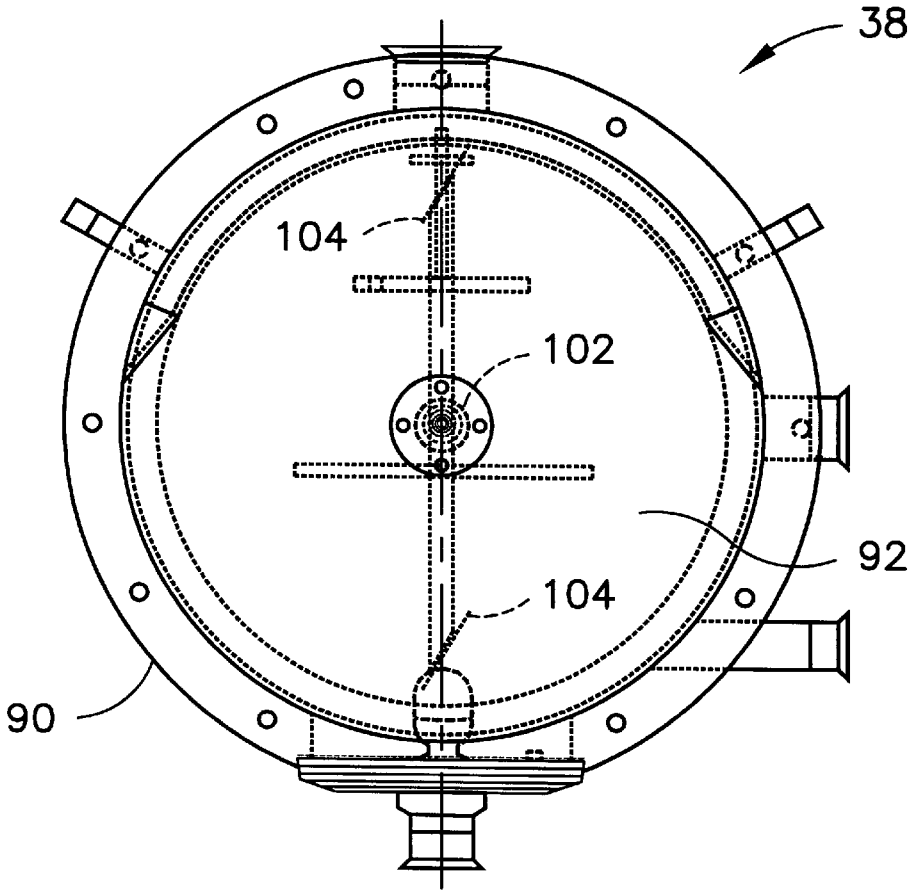
Figure 4:
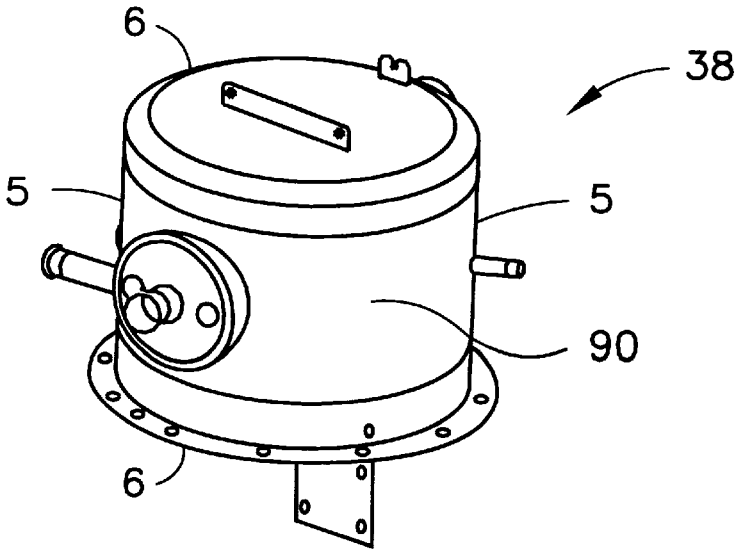
Figure 6:
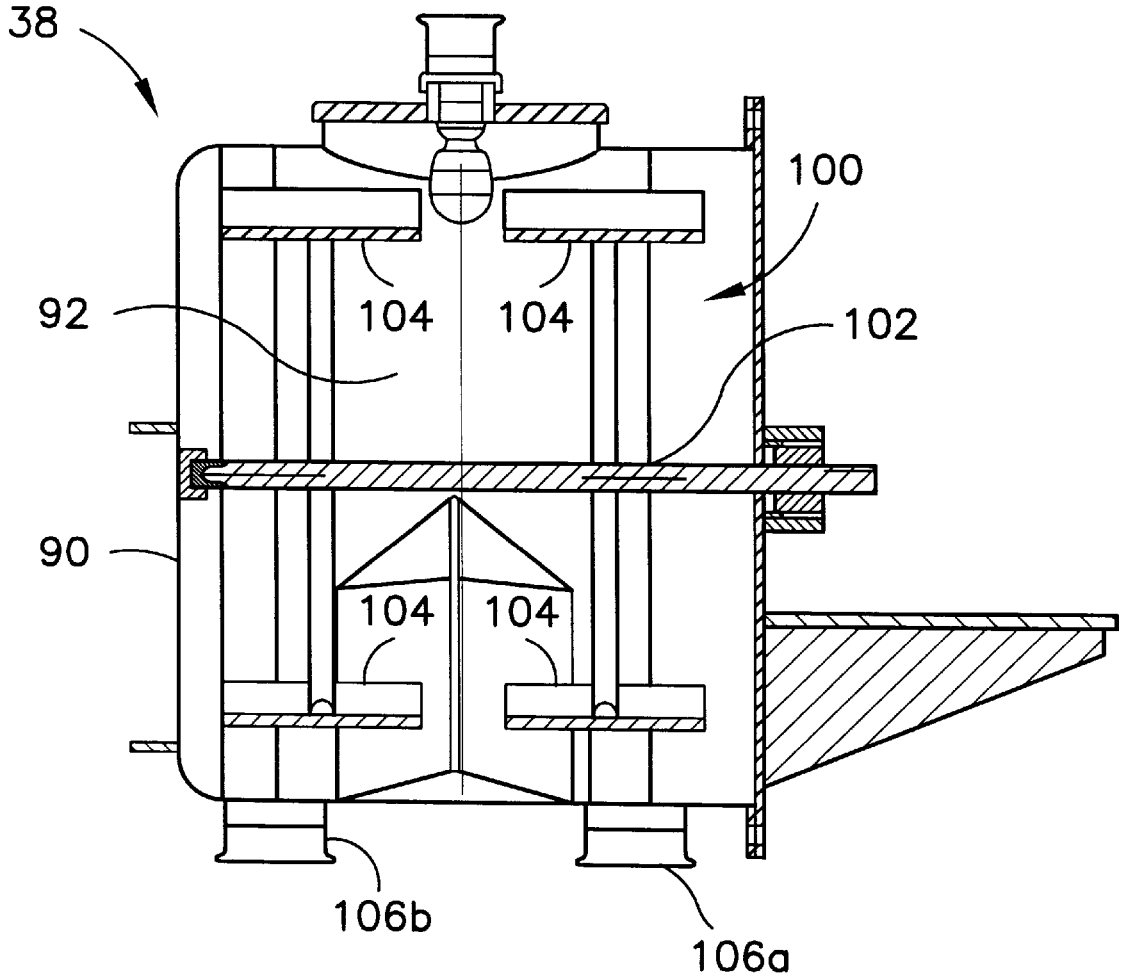
Figure 7:
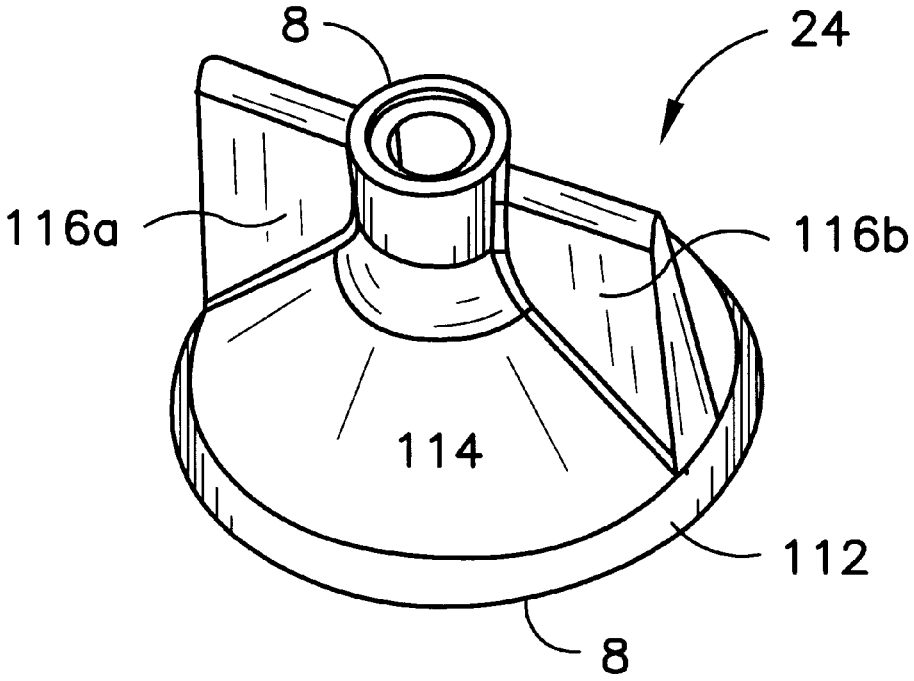
Figure 8:
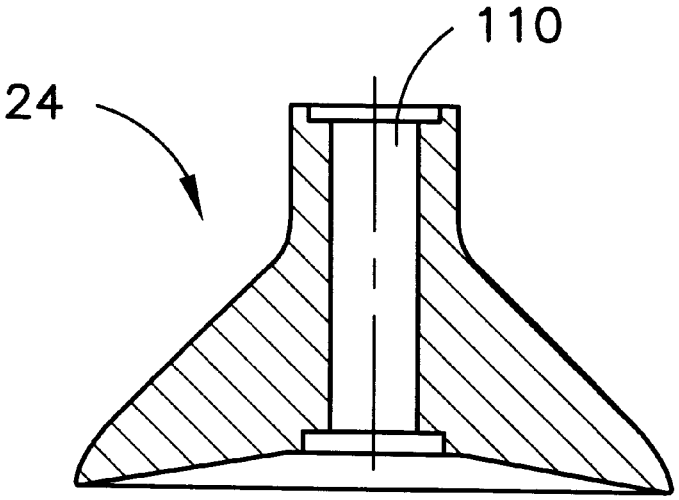
Figure 9:
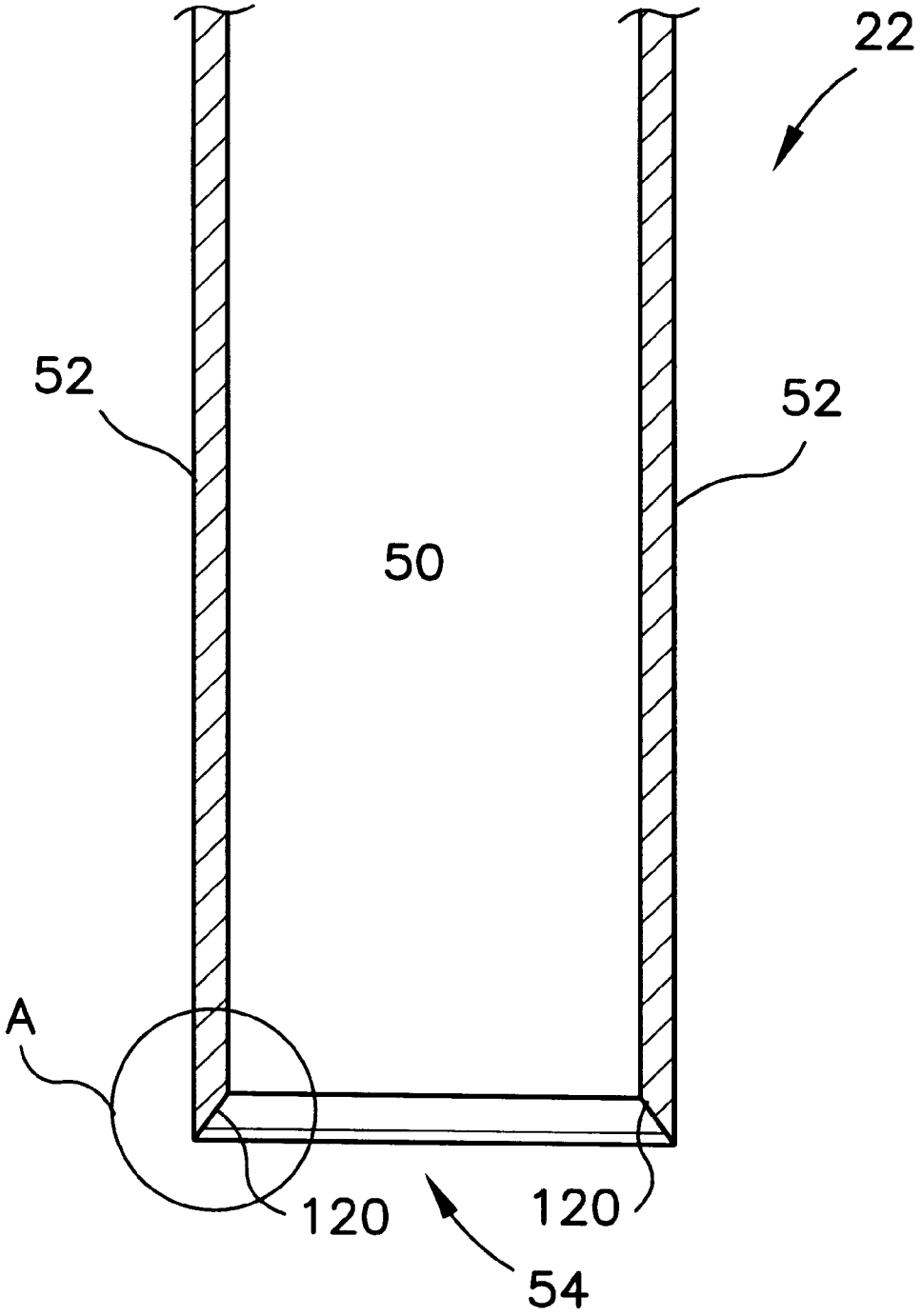
Figure 10:
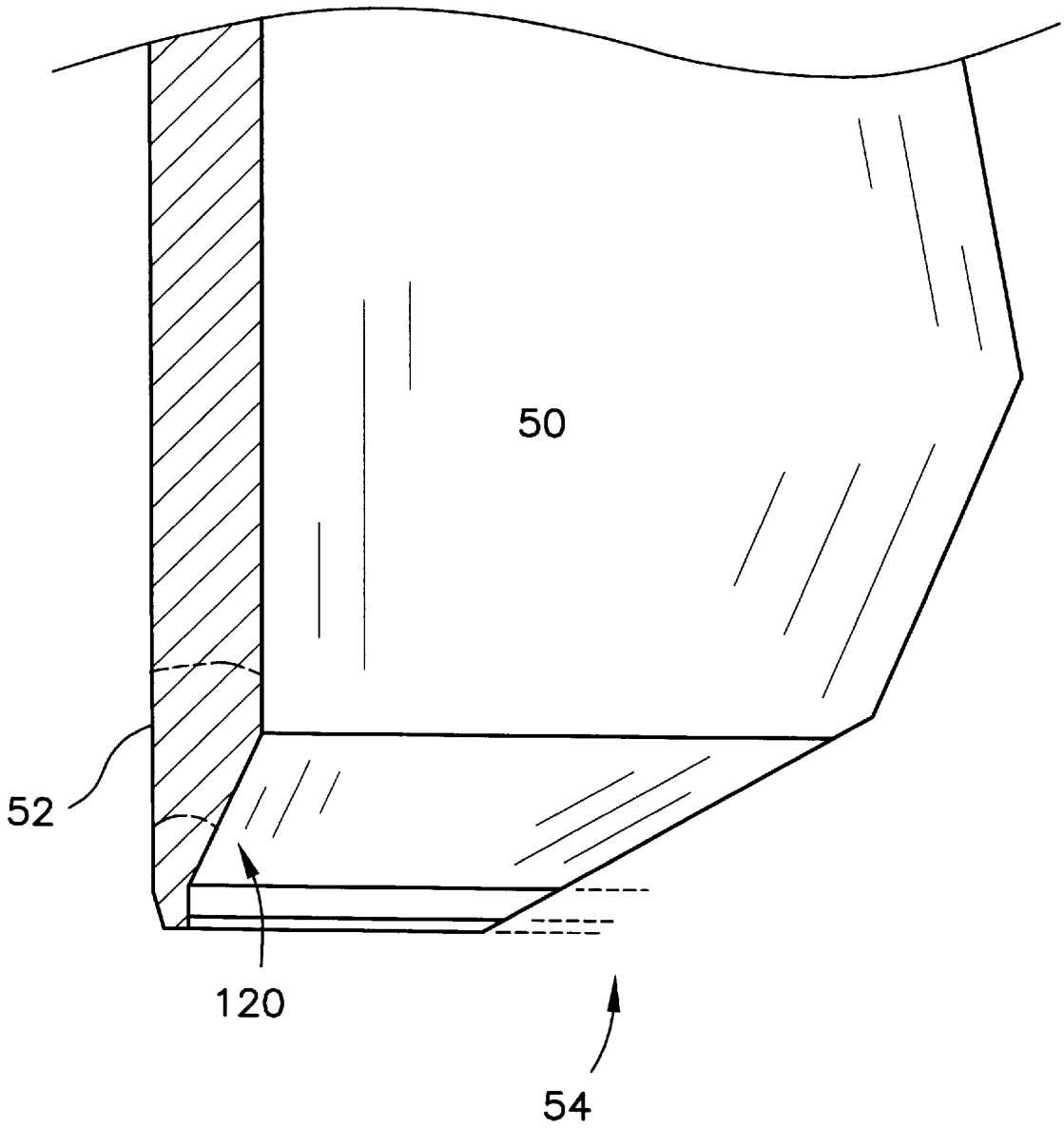
Figure 11:
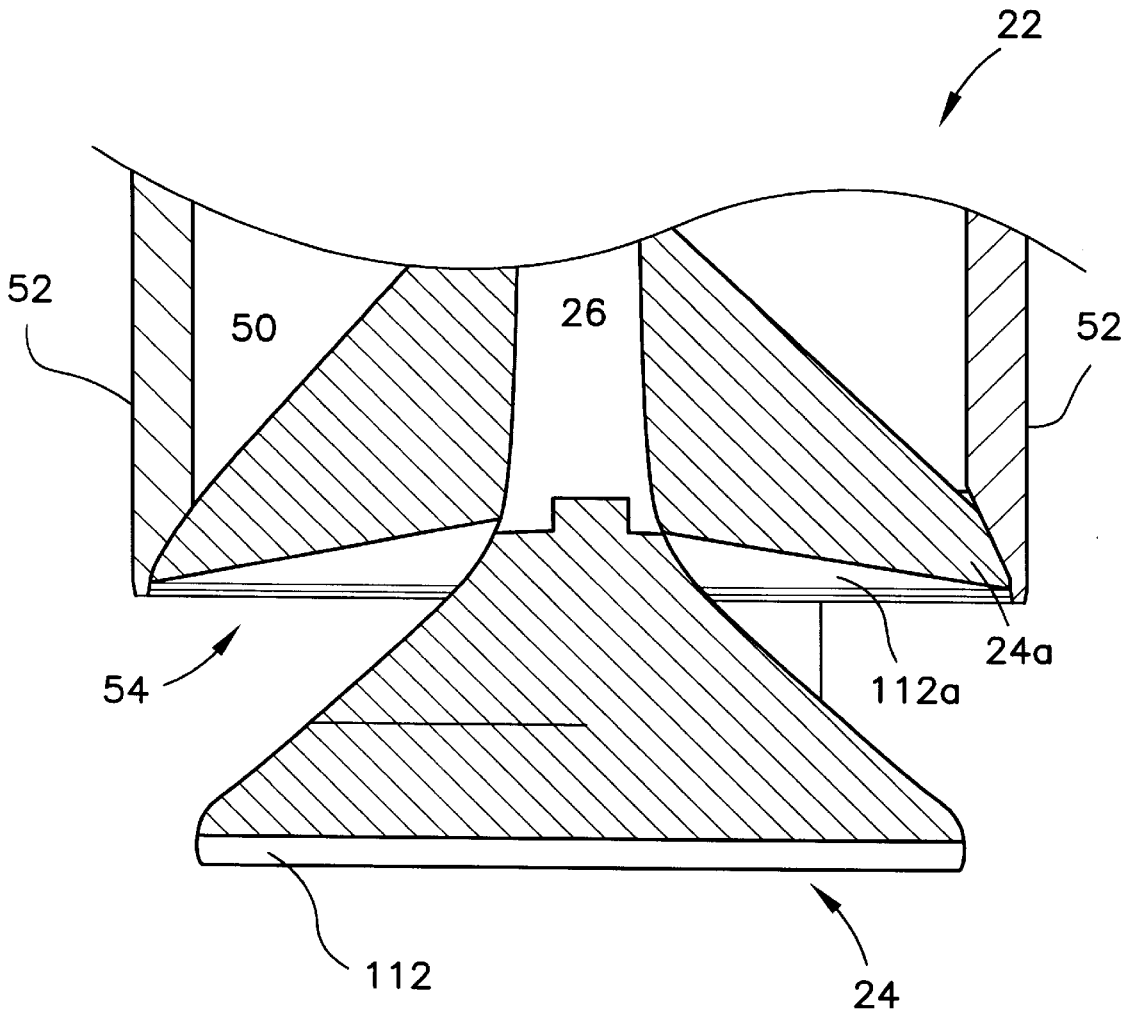
Figure 12:
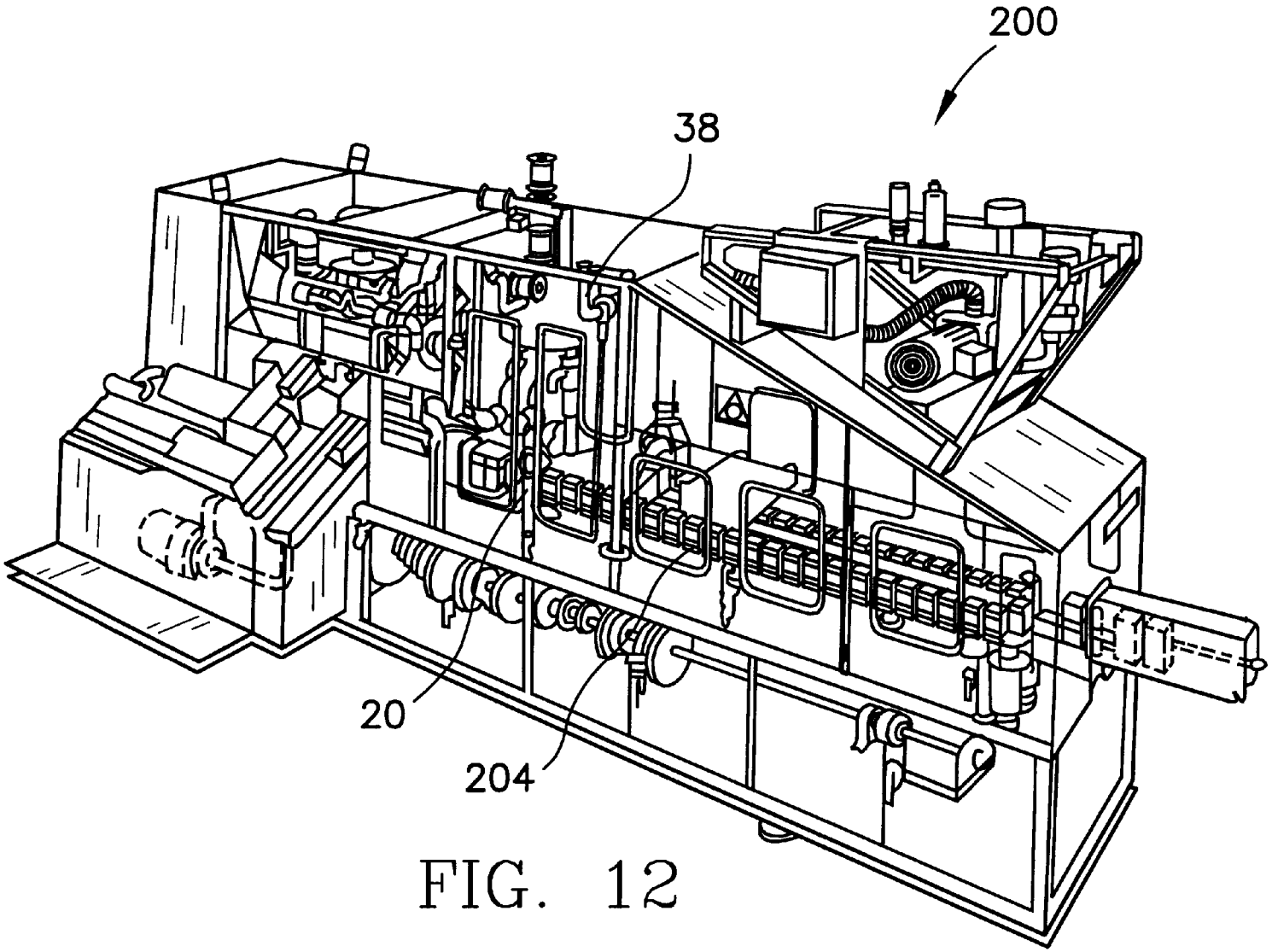
Figure 13:
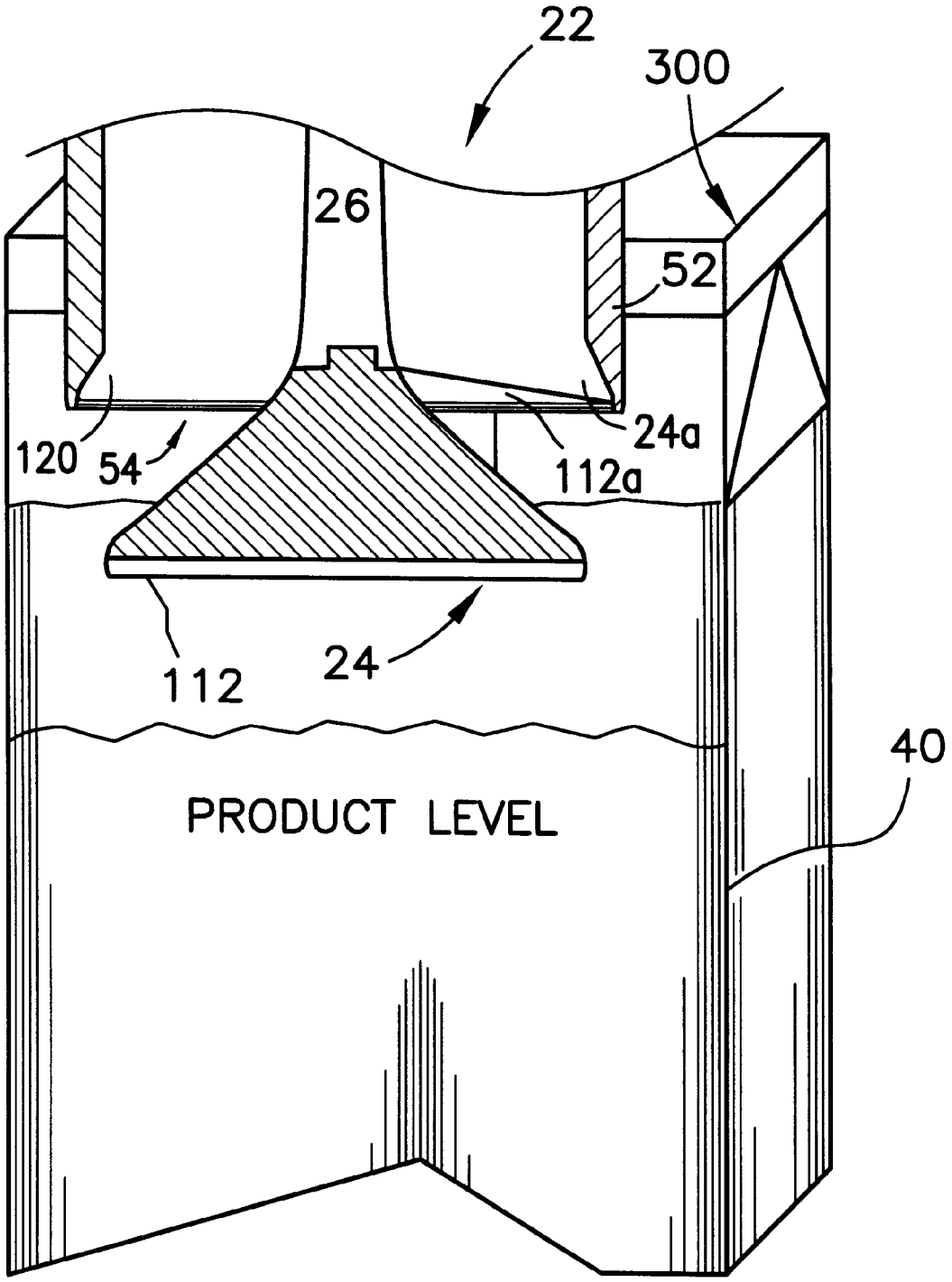
Figure 13A:
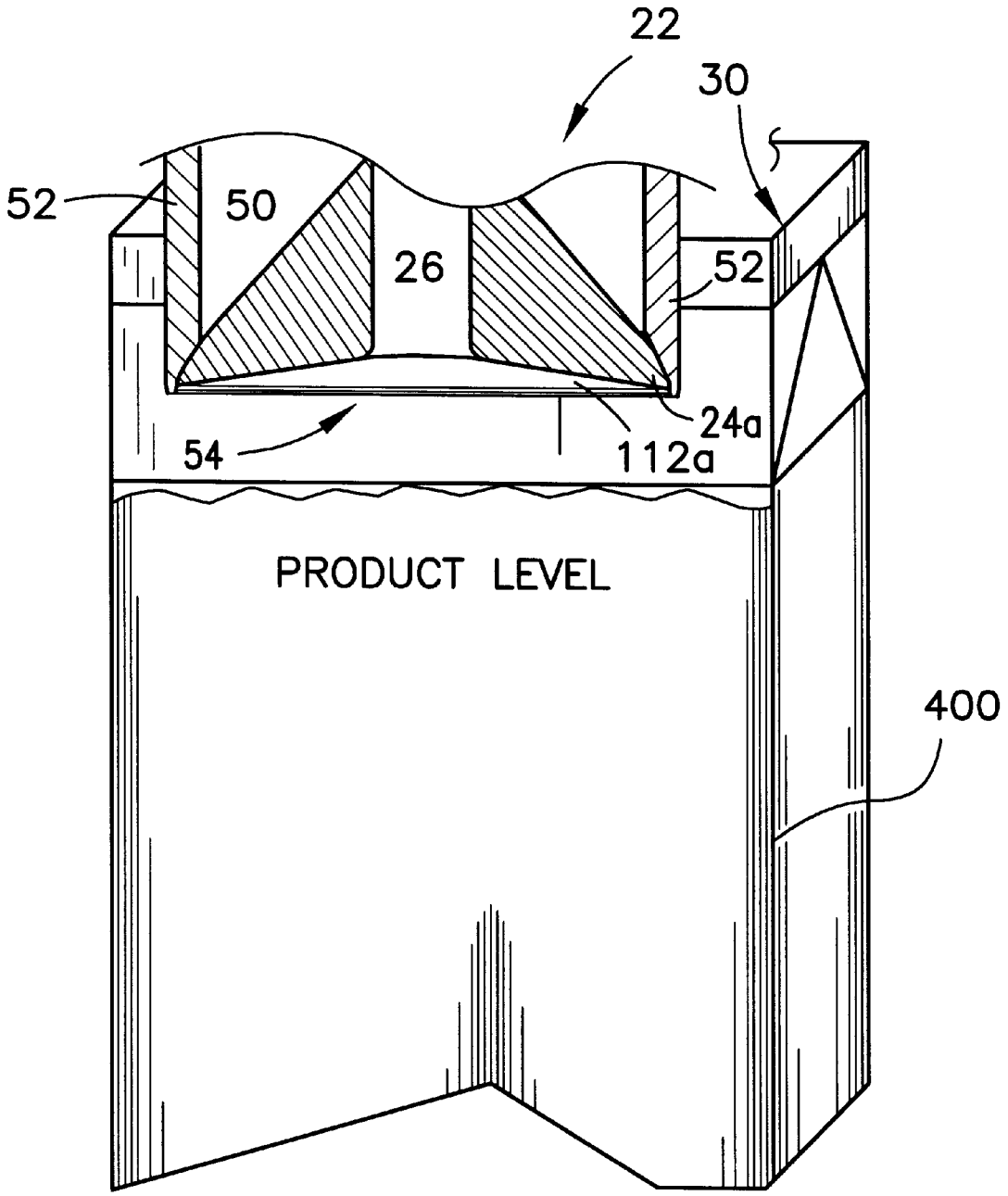
Figure 14:
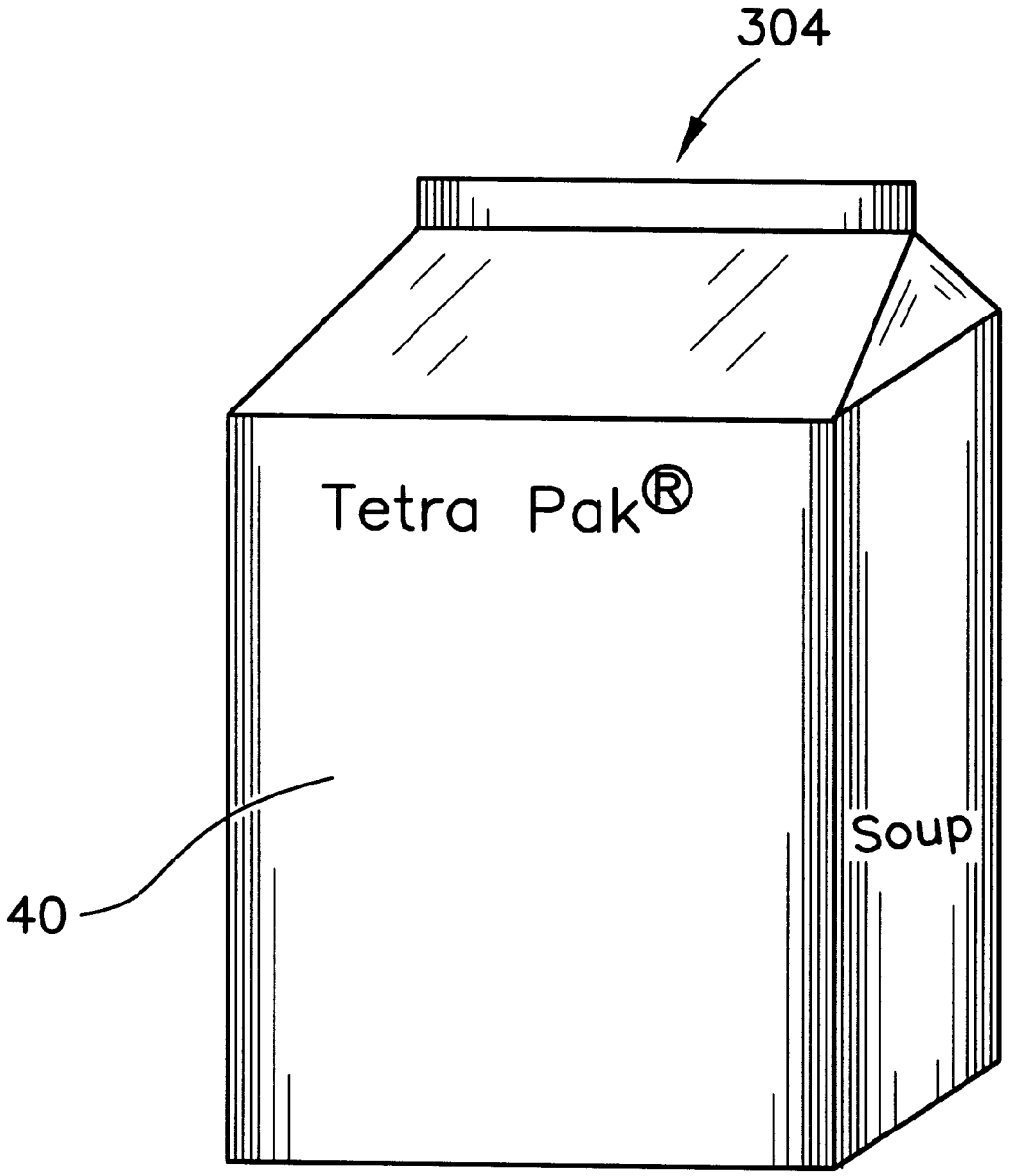

There is illustrated in FIG. 2 an isolated cross-sectional view of the fill pipe, transfer pipe and sealing cone with linkage of the filling system of the present invention;

There is illustrated in FIG. 3 the knife-gate valve of the filling system of the present invention;

There is illustrated in FIG. 4 an isolated perspective view of the product tank of the filling system of the present invention;

There is illustrated in FIG. 5 an isolated front view of the product tank of FIG. 4;

There is illustrated in FIG. 6 an isolated cross-sectional view of the product tank along line 6—6 of FIG. 4;

There is illustrated in FIG. 7 an isolated top perspective view of a sealing cone of the filling system of the present invention;

There is illustrated in FIG. 8 a cross-sectional view of th e sealing cone along line 8—8 of FIG. 7;

There is illustrated in FIG. 9 an isolated cross-sectional view of the fill pipe of the filling system of the present invention;

There is illustrated in FIG. 10 an enlargement of circle A of FIG. 9; and There is illustrated in FIG. 11 an isolated cross-sectional view of the sealing cone and fill pipe of the filling system of the present invention in an open position and in a superimposed closed position;

There is illustrated in FIG. 12 a perspective view of a packaging machine with the filling system of the present invention thereon;

There is illustrated in FIG. 13 an isolated view of a carton in relation with the sealing cone and fill tube during filling of the carton with product from the filling system of the present invention;

There is illustrated in FIG. 13A an isolated view of a carton in relation with the sealing cone and fill tube of the present invention immediately after the filling operation has been completed for this carton;

There is illustrated in FIG. 14 a top perspective view of a sealed carton filled with product from the filling system of the present invention.

DETAILED DESCRIPTION OF THE INVENTION

Figure 1:
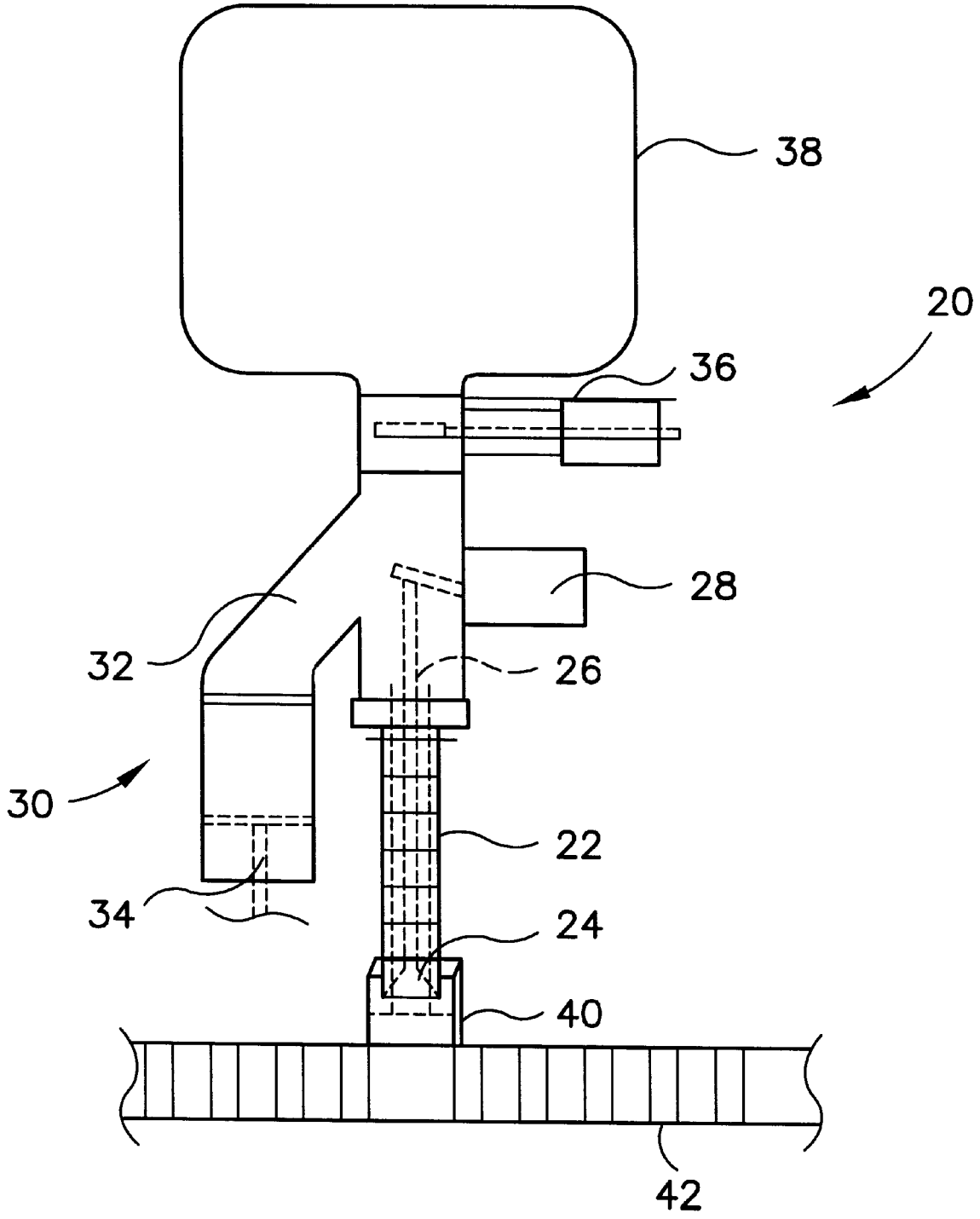

As shown in FIG. 1, a filling system is generally designated 20. The filling system includes a fill pipe 22, a sealing cone 24 having a linkage 26 to a control mechanism 28, a pump mechanism 29 with a pump chamber 30, transfer pipe 32 piston 34, a knife-gate valve 36 and a product tank 38. A carton 40 is conveyed below the filling system 20 by a conveyor means 42.

As shown in FIG. 2, the linkage 26 for the sealing cone 24 is disposed within the fill pipe 22 and a portion of the transfer pipe 32. The fill pipe 22 is generally cylindrical and has a hollow interior 50 defined by a continuous wall 52. The fill pipe 22 has a dispensing end 54 and an inlet end 56. Each of the ends 54 and 56 are open thereby allowing for the flow of a product through the fill pipe 22.

The sealing cone 24 is attached to the linkage 26 near the dispensing end 54 of the fill pipe 22. In a closed position, the sealing cone 24 seals the dispensing end 54 of the fill pipe 22 thereby preventing the flow of product therethrough. In an open position, the sealing cone 24 is lowered away from the dispensing end 54 thereby allowing for product to flow into a container positioned below. The sealing cone is actuated by a control mechanism 28 via the linkage 26. The control mechanism may be controlled by a programmable logic controller ("PLC") 60 which coordinates the opening and closing of the sealing cone 24 with the other operations of the filling system 20.

The inlet end 56 of the fill pipe 22 is in flow communication with the transfer pipe 32 of a pump mechanism 29. The transfer pipe 32 may be divided into a first portion 62 and a second portion 64. The first portion 62 is parallel with the fill pipe 22 and the second portion 64 is angled to the first portion 62. The piston 34 lies in the second portion 64. A part of the linkage 26 lies within the first portion 62. The pump mechanism 29 provides the internal pressure to the filling system 20 to pump the product out of the fill pipe 22 and into a container 40 below. The upward and downward motion of the piston 34 creates the pressure differentials inside the pump chamber 30, the transfer pipe 32 and fill pipe 22. The upward motion of the piston 34 forces the product from the dispensing end 54 and into a container 40. Of course, during this upward motion of the piston 34, the sealing cone 24 is an open position.

As shown in FIG. 3, the knife gate valve 36 has a valve housing 70, a condensed water chamber 72 and a pneumatic cylinder 74. The valve housing 70 has an inlet 76 and an outlet 78 to a hollow cavity 80 defined by interior walls 75. Inside the hollow cavity 80 is the valve member 82. The valve member 82 is connected to the pneumatic cylinder 74 which provides for forward and rearward movement of the valve member 82. The valve member 82 has O-rings 84, the O-rings encapsulated within a fluoroplastic seal, to provide a tight seal against the interior walls 75 when the valve member 82 is in a closed position to prevent product flowing from the product tank 38 to the transfer pipe 32. In the open position, the valve member 82 is moved rearward to a retraction cavity 88 thereby allowing for the unhindered flow of product from the product tank 38 to the transfer pipe 32 through the hollow cavity 80 of the valve housing 70.

As shown in FIGS. 4–6, the product tank 38 has a housing 90 defining a hollow chamber 92. Inside the chamber 92 is a means for agitating 100 the product to evenly distribute the particulates throughout the liquid portion of the product. The agitating means 100 may be a shaft 102 having a plurality of paddles 104 attached thereon. The shaft 102 is rotated about a fixed axis thereby rotating the paddles 104. The paddles agitate the product thereby preventing the accumulation of particulates in one area. This allows for a better flow of product through the outlets 106*a–b*.

As shown in FIGS. 7–8, the sealing cone 24 has a cavity 10 for engaging with the linkage 26. The sealing cone 24 has a cutting edge 112 which as described below, engages with the fill pipe to create a tight seal to prevent the dripping of product from the fill pipe onto the sealing areas of a container being processed along the conveyor means 42. The sealing cone 24 also has a main body 114 with a pair of fins 116*a–b*.

As shown in FIGS. 9–10, the fill pipe 22 has a circumferential recessed area 120 at its dispensing end 54. The recessed portion 120 is created from a portion of the wall 52 of the fill pipe 22. FIG. 11 shows the sealing cone in relation with the fill pipe 22, and particularly, the circumferential recessed area 120 which engages the cutting edge 112 of the sealing cone 24. The engagement of the cutting edge and the recessed area 120 prevents dripping of product from the fill pipe. It also cuts off any particulates that might hinder the tight sealing of the sealing cone 24 with the fill pipe 22. If the seal between the sealing cone 24 and the fill pipe 22 is inadequate, then product may flow onto a container prior to proper positioning of the container under the fill pipe 22. Such a scenario may lead to sealing problems with the container that would render the container defective. In particular, the packaging of soup for extended shelf life with refrigeration necessitates proper sealing of the container. The filling system 22 should not interfere with the sealing of a container of soup. FIG. 11 also shown the sealing cone engaged with the fill tube 22 with sealing cone 24*a* and cutting edge 112*a* fully retracted in a sealing position.

A packaging machine 200 is shown in FIG. 12 with the filling system 20 of the present invention thereon. The packaging machine 200 may have a PLC 60 for controlling not only the filling system 20, but the other movements of components on the packaging machine 200. A preferred control system is disclosed in U.S. Pat. No. 5,706,627 for a Control System For A Packaging Machine which is hereby incorporated by reference in its entirety, and which has the same assignee as the present application. The sealing station 204 is downline from the filling system 20 and thus dripping of product on a container would have an immediate effect on the sealing operation.

During processing, the carton bottom is first formed on a mandrel wheel and then the carton is placed on a conveyor mechanism. The conveyance of the cartons is indexed to the slowest operation, which is usually the top sealing operation. The cartons may be sterilized at a sterilization station, then conveyed to the filling system 20. At the filling system 20, each carton is lifted for bottom-up filling. Bottom-up filling involves the carton being lowered as it is filed to prevent sloshing of the product on the sealing areas. As shown in FIGS. 13 and 13A, the sealing areas 300 of the carton 40 are near the top and form the top fin 304 as shown in FIG. 14. If a product, such as soup, splashes or drips on the sealing areas 300, then a poor seal may result thus rendering the carton and product defective.

The present invention prevents splashing and dripping of the product onto the seal areas 300. Once the filling of the carton 40 is completed, the sealing cone 24 is retracted by the control mechanism 28 via the linkage 26 thereby sealing the fill tube 22. As the cutting edge 112 engages the circumferential recessed area 120, any particulates that might have remained on the filling tube 22 are cut or crushed thereby allowing for a tight seal of the fill tube 22. The dripping of product is prevented by the tight seal and splashing is prevented by the bottom-up filling process. The carton is then fully lowered onto the conveyor and conveyed to the top sealing station where the fin 304 is created on the carton 40.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A filling system for filling cartons with a liquid product with particulates therein, the cartons conveyed along a predetermined path, the filling system comprising:

a fill pipe disposed above the predetermined path, the fill pipe having an dispensing end and an inlet end, the dispensing end having a circumferential recessed portion;

a sealing cone having a linkage through the fill pipe to a control mechanism, the sealing cone having a cutting edge that mates with the circumferential recessed portion of the fill pipe;

a pump mechanism having a pump chamber and a transfer pipe in flow communication with the fill pipe;

a product tank for holding the liquid product with particulates, the product tank in flow communication with the transfer pipe and pump chamber; and a knife-gate valve juxtaposed between the product tank and the transfer pipe, the knife-gate valve controlling the flow of liquid product with particulates from the product tank to the transfer pipe.

2. The filling system according to claim 1 wherein the product tank has means for agitating the liquid product with particulates.

3. The filling system according to claim 1 wherein the sealing cone has an open position for filling a carton and a closed position, the cutting edge engaged with the circumferential recessed portion of the fill pipe when the sealing cone is in the closed position.

4. The filling system according to claim 3 wherein the knife -gate valve has an open position and a closed position, the knife-gate valve in the closed position when the sealing cone is in the open position, and the knife-gate valve in the open position when the sealing cone is in the closed position.

5. The filling system according to claim 1 wherein the engagement of the cutting edge of the sealing cone and the circumferential recessed area of the fill pipe substantially prevents the flow of the liquid product with particulates from the fill pipe.

6. A packaging machine for forming, filling and sealing a series of cartons with a liquid product with particulates, the series of cartons conveyed along a carton path, the packaging machine comprising:

a first fill pipe and a second fill pipe, both disposed above the carton path, each of the first and second fill pipes having a dispensing end and an inlet end, the dispensing end having a circumferential recessed portion;

a first sealing cone having a linkage through the first fill pipe to a first control mechanism, the first sealing cone having a cutting edge that mates with the circumferential recessed portion of the first fill pipe;

a second sealing cone having a linkage through the second fill pipe to a second control mechanism, the second sealing cone having a cutting edge that mates with the circumferential recessed portion of the second fill pipe;

a first pump mechanism having a first pump chamber and transfer pipe in flow communication with the first fill pipe;

a second pump mechanism having a second pump chamber and transfer pipe in flow communication with the second fill pipe;

a product tank for holding the liquid product with particulates, the product tank in flow communication with the first transfer pipe through a first outlet and the product tank in flow communication with the second transfer pipe through a second outlet; and a first knife-gate valve juxtaposed between the product tank and the first transfer pipe, and a second knife-gate valve juxtaposed between the product tank and the second transfer pipe, the knife-gate valves controlling the flow of liquid product with particulates from the product tank to the transfer pipes.

7. The packaging machine according to claim 6 wherein the first and second fill pipes fill adjacent cartons simultaneously.

8. The packaging machine according to claim 6 wherein the product tank has means for agitating the liquid product with particulates.

9. The packaging machine according to claim 6 wherein the fist and second sealing cones each has an open position for filling a carton and a closed position, the cutting edge of each of the sealing cones engaged with the circumferential recessed portion of each of the first and second fill pipes when each of the sealing cones are in the closed position.

10. The packaging machine according to claim 9 wherein the first and second knife-gate valves each has an open position and a closed position, the knife-gate valves in the closed position when each of the corresponding sealing cones is in the open position, and the knife-gate valves in the open position when each of the corresponding sealing cones is in the closed position.

11. The packaging machine according to claim 6 further comprising a first lifter and a second lifter, the lifters disposed below the carton conveyance means, the lifters lifting cartons about each of the fill pipes bottom-up filling.

12. The packaging machine according to claim 10 further comprising a PLC for controlling the opening and closing of the sealing cones and the knife-gate valves.

13. A method for filling a series of cartons with a liquid product having particulates, the series of cartons conveyed along a predetermined path of a form, fill and seal packaging machine, the method comprising:

opening a knife-gate valve juxtaposed between a product tank and a pump chamber, the product tank holding the liquid product having particulates, the opening of the knife-gate valve allowing for the liquid product having particulates to flow into the pump chamber through a transfer pipe;

closing the knife-gate valve;

opening a dispensing end of a fill pipe by lowering a sealing cone, the fill pipe in flow communication with the pump chamber through the transfer pipe;

pumping the liquid product through the pump chamber, the transfer pipe, the fill pipe and the dispensing end of the fill pipe and into a carton; and closing the dispensing end of the fill pipe by actuation of the sealing cone to engage a cutting edge of the sealing cone with a circumferential recessed portion of the fill pipe after filling the carton.

14. The method according to claim 13 further comprising lifting a carton about the fill pipe for bottom-up filling of the carton with the liquid product having particulates.

15. A method for filling a series of cartons with a liquid product having particulates, the series of cartons conveyed along a predetermined path of a form, fill and seal packaging machine, the method comprising:

opening a knife-gate valve juxtaposed between a product tank and a pump chamber, the product tank holding the liquid product having particulates, the opening of the knife-gate valve allowing for the liquid product having particulates to flow into the pump chamber through a transfer pipe;

closing the knife-gate valve;

opening a dispensing end of a fill pipe by lowering a sealing cone, the fill pipe in flow communication with the pump chamber through the transfer pipe;

pumping the liquid product through the pump chamber, the transfer pipe, the fill pipe and the dispensing end of the fill pipe and into a carton; and agitating the liquid product having particulates inside the product tank to distribute the particulates about the liquid of the liquid product.

16. The method according to claim 15 further comprising lifting a carton about the fill pipe for bottom-up filling of the carton with the liquid product having particulates.

* * * * *